US010309149B2

(12) United States Patent
Derode

(10) Patent No.: US 10,309,149 B2
(45) Date of Patent: Jun. 4, 2019

(54) CONTAINMENT DEVICE COMPRISING A DRY CURTAIN

(71) Applicant: AIRBUS SAFRAN LAUNCHERS SAS, Issy-les-Moulineaux (FR)

(72) Inventor: Thibault Derode, Bordeaux (FR)

(73) Assignee: AIRBUS SAFRAN LAUNCHERS SAS, Issy-les-Moulineaux (FR)

( * ) Notice: Subject to any disclaimer, the term of this patent is extended or adjusted under 35 U.S.C. 154(b) by 155 days.

(21) Appl. No.: 15/319,157

(22) PCT Filed: Jun. 16, 2015

(86) PCT No.: PCT/EP2015/063453
§ 371 (c)(1),
(2) Date: Dec. 15, 2016

(87) PCT Pub. No.: WO2015/193297
PCT Pub. Date: Dec. 23, 2015

(65) Prior Publication Data

US 2017/0130521 A1 May 11, 2017

(30) Foreign Application Priority Data

Jun. 17, 2014 (FR) ..... 14 55551

(51) Int. Cl.

| | |
|---|---|
| ***E01F 13/00*** | (2006.01) |
| ***E06B 5/12*** | (2006.01) |
| ***E06B 9/06*** | (2006.01) |
| ***E06B 9/17*** | (2006.01) |
| ***E04B 1/94*** | (2006.01) |
| ***E04C 3/02*** | (2006.01) |
| ***E04H 9/04*** | (2006.01) |

(Continued)

(52) U.S. Cl.
CPC ..... *E06B 5/125* (2013.01); *E04B 1/941* (2013.01); *E04C 3/02* (2013.01); *E04H 9/04* (2013.01);

(Continued)

(58) Field of Classification Search
CPC .... E06B 5/125; E06B 9/0692; E06B 9/17046; E06B 5/16; E06B 2009/135; E04C 3/02;

(Continued)

(56) References Cited

U.S. PATENT DOCUMENTS 3,499,290 A * 3/1970 Smith ..... E02B 3/062 405/72
3,757,526 A * 9/1973 Larsson ..... E02B 15/08 405/70

(Continued)

FOREIGN PATENT DOCUMENTS

FR 2300582 9/1976
FR 2999637 6/2014

OTHER PUBLICATIONS

International Search Report, International Application No. PCT/EP2015/063453, dated Oct. 6, 2015.

*Primary Examiner* — Chi Q Nguyen
(74) *Attorney, Agent, or Firm* — Gottlieb, Rackman & Reisman, PC

(57) ABSTRACT

A containment device including a dry curtain, adapted to be deployed for the containment or re-containment of a discharge area, such as an opening, e.g. a door, in response to an explosion. The device includes a ballast bar in the lower portion of the curtain, the ballast bar including cylinders of high-density foam alternated with cylinders of compressible low-density foam.

17 Claims, 3 Drawing Sheets

(51) Int. Cl.
*E06B 1/52* (2006.01)
*E06B 5/16* (2006.01)
*E06B 9/13* (2006.01)

(52) U.S. Cl.
CPC ..... *E06B 1/522* (2013.01); *E06B 5/16* (2013.01); *E06B 9/0692* (2013.01); *E06B 9/17046* (2013.01); *E04C 2003/023* (2013.01); *E06B 2009/135* (2013.01)

(58) Field of Classification Search
CPC ..... E04C 2003/023; E04C 2003/026; E04B 1/944; E04B 1/947; E04H 9/04; E04H 9/14; E04H 9/145
USPC ..... 49/9, 10, 11, 58
See application file for complete search history.

(56) References Cited

U.S. PATENT DOCUMENTS 4,077,474 A 3/1978 Hattori
5,149,226 A * 9/1992 Antinoro ..... E02B 15/08 405/65
5,197,821 A * 3/1993 Cain ..... E02B 15/08 405/68
5,269,627 A * 12/1993 Neal ..... E02B 15/08 405/70
6,743,367 B2 * 6/2004 Dreyer ..... E02B 15/08 210/170.05
7,056,059 B1 * 6/2006 Wong ..... E02B 15/08 210/242.1
7,097,767 B2 * 8/2006 Gunderson ..... B01D 17/00 210/615
9,340,941 B2 * 5/2016 Meyers ..... E02B 3/26
2003/0188837 A1 10/2003 Varley et al.
2006/0186701 A1 * 8/2006 Browne ..... B62D 21/15 296/187.02
2011/0067891 A1 * 3/2011 Linares ..... A62C 2/10 169/48
2012/0020732 A1 * 1/2012 Stiles ..... E02B 15/06 405/63
2015/0361714 A1 12/2015 Derode et al.

* cited by examiner

CONTAINMENT DEVICE COMPRISING A DRY CURTAIN

CROSS REFERENCE TO RELATED APPLICATIONS

This application is the National Stage of International Application No. PCT/EP2015/063453, having an International Filing Date of 16 Jun. 2015, which designates the United States of America, and which International Application was published under PCT Article 21(2) as WO Publication No. 2015/193297 A1, and which claims priority from and the benefit of French Application No. 1455551, filed 17 Jun. 2014, the disclosures of which are incorporated herein by reference in their entireties.

BACKGROUND

1. Field

The disclosed embodiment relates to the field of the containment of methods that involve high risks of emission of particularly toxic or radioactive substances.

It relates more generally to a dry curtain containment device for securing infrastructures involving high-risk processes when risks of explosion and blast (pyrotechnic, chemical, etc) and risks of emission of toxic chemical substances or of radioactive substances are present.

Its objective is to afford collective protection in an industrial safety and civilian safety environment.

2. Brief Description of Related Developments

When a method combines high risks of explosion and blast with high risks of emission of particularly toxic or radioactive substances, it is desirable to be able to contain the method within an infrastructure such as a building that opposes the spread of these substances.

Depending on the amount of energy involved in the event of an explosion, it may be illusory, or at the very least prohibited, to create a building that is totally sealed in the event of a blast.

In the case of a building that is not sealed, it is possible to limit the amount of effluent emitted by defining a discharge surface that will allow the building to maintain its integrity, this discharge surface operating as a relieve valve.

In the context of the presently disclosed embodiment we are assuming a building that is resistant to a blast and does not collapse.

Even if a portion of the toxic or radioactive substances is emitted at the time of the explosion through the discharge surface of the building, immediate recontainment of the building at the discharge surface is highly beneficial and makes it possible to greatly limit, or even eliminate gaseous or particulate emissions after the blast and thus limit the risk of harmful effects on personnel and surrounding populations.

The containment solutions for communal protection in the field of industrial risks are at varying stages of development.

In the event of a fire, containment by a curtain of water triggered upon detection of a fire and fire-break partitioning are nowadays widely used and numerous devices created according to this principle are available.

The creation of containment zones for gaseous or particulate emissions is well known for installations that do not carry a risk of explosion.

For completely uncontained zones, abatement technologies employing curtains of water are widely used.

The disadvantages with containment using a curtain of water are that its effectiveness decreases over time and that its autonomy is limited or requires a continuous supply of water.

There is also a recontainment technology using an automatic or controlled moving door, but the main problem is that of guaranteeing that the door remains functional after the effects of the blast and notably the shockwave, the impacts of fragments or the deformation of the building.

Furthermore, these doors take a non-insignificant time to operate.

A dry curtain device is also described in French publication number FR2999637 A1 filed on 20 Jun. 2014 in the name of the applicant company and incorporated here by reference in its entirety.

SUMMARY

The presently disclosed embodiment seeks to improve the recontainment solutions with a very short response time, high effectiveness and level of sealing, high reliability and good resistance to the attacks associated with the initial explosion: Shockwave, fragments, deformation of the building.

In order to do this, the disclosed embodiment proposes a containment device comprising a dry curtain designed to deploy in such a way as to contain or recontain a discharge zone, such as an opening of a room or building, for example a door, in response to a blast, which comprises a ballast bar in the lower part of the curtain, said ballast bar comprising an alternation of cylinders of foam of a first density referred to as high density and of cylinders of compressible foam of a second density referred to as low density.

Advantageously, the cylinders of high density foam have a length of 100 mm to 300 mm.

According to one particular aspect, the cylinders of low density foam have a length of 20 mm to 60 mm.

For preference, said cylinders are threaded onto a cord.

The cylinders which are low density cylinders are advantageously designed to deform in order to allow the ballast bar to conform to the shape of an obstacle on the ground, the high-density cylinders therefore hugging the shape of the obstacle.

According to one particular aspect, the diameter of the ballast is 60 mm to 100 mm, the low and high density cylinders being sized so as to be able to hug an obstacle 50 mm to 150 mm thick.

The device advantageously comprises stiffeners evenly distributed through the curtain.

The stiffeners are preferably aluminum profile sections.

Strips of fabric for retaining the stiffeners are advantageously stitched locally to the fabric of the curtain, the profile sections being slipped in between the strips and the curtain.

The length of the stiffeners is advantageously such that they press the curtain against lintels of the opening that is to be recontained notably when the room that is to be contained returns to a state of depression after the blast.

The stiffeners are advantageously shorter than the width of the curtain such that strips of curtain beyond the stiffeners maintain their flexibility and are able to act as a seal against the lintels or surround of the opening when the room that is to be contained returns to a state of depression after the blast.

The strips of fabric supporting the stiffeners preferably stop in line with a fixed frame of the opening that is to be recontained, leaving the stiffeners free beyond that.

The stiffeners advantageously rest against the fixed frame over 50 mm to 100 mm.

Alternatively or in addition, the curtain rests against the fixed frame over 150 mm to 200 mm.

The curtain stiffeners are advantageously stitched every 400 mm to 600 mm over the height of the curtain.

According to one particular aspect, the curtain comprises a glass weave and a PTFE (polytetrafluoroethylene) coating.

BRIEF DESCRIPTION OF THE DRAWINGS

Other features and advantages of the disclosed embodiment will become apparent from reading the following description of some nonlimiting examples which is accompanied by the drawings which depict.

DETAILED DESCRIPTION

The disclosed embodiment provides a device comprising a dry curtain arranged in such a way as to be able to contain or recontain a discharge zone, for example a door, in response to the blast of an explosion. The device of the disclosed embodiment is produced in such a way as to deploy rapidly and to be unlikely to be found to be defective following an explosion.

The material of the curtain is chosen according to the chemical resistance performance required but is typically made up of a woven fabric coated on both sides with one or more layers of one or more sealing materials, the weave also being equipped with horizontal stiffeners distributed over the entire height of the curtain.

Figure 1:
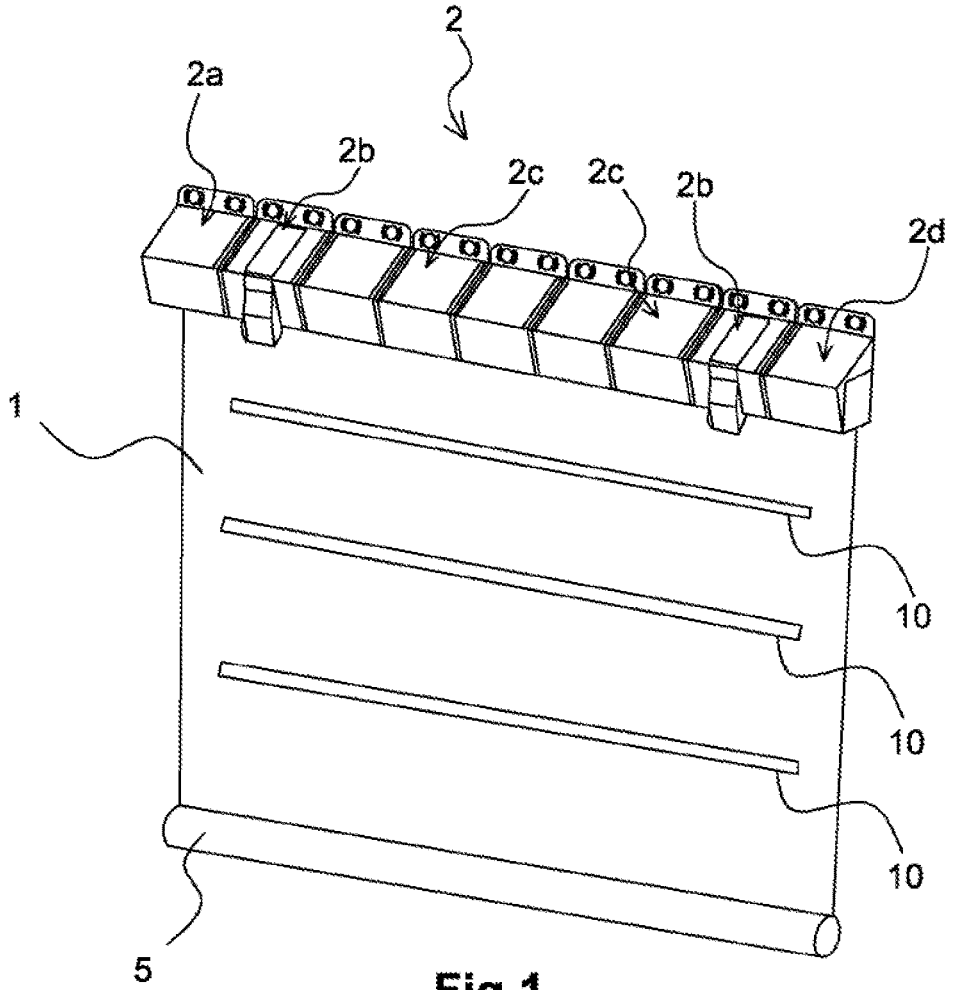
FIG. 1 is a perspective view of a containment device according to the disclosed embodiment, deployed.

FIG. 1 depicts the curtain 1 deployed along the surround of a door.

The curtain has deployed from a modular box 2 and comprises a compensation seal 5 which rests on the ground.

The curtain storage box 2 is made up of a plurality of juxtaposed modules 2*a*, 2*b*, 2*c*, 2*d*, the plurality of modules comprising modules 2*b* referred to as active modules which are provided with curtain retaining and release means which will foe detailed further on, and modules referred to as passive modules 2*a*, 2*c*, 2*d* which do not have said means for retaining and releasing the curtain 1.

In the event of an explosion, the fact that the box is made in the form of modules sized to withstand explosions allows the box to deform if the door lintel deforms.

For a door measuring 4 m wide and a door height of 4 m, assuming that the curtain overhangs the fixed frame by 50 cm on each side, a box in the form of a parallelepiped measuring approximately 0.8×0.6×5 m is required.

The suitable number of modules for this length is selected in the knowledge that use is made of two end modules 2*a* and two active modules 2*b*, as many additional passive modules 2*c* as required being positioned between the active modules.

A small explosion fixed for example at 40 g of TNT, located on the ground 5 m away from the door will generate a dynamic overpressure spike of around 7000 Pa on the blow-out panel, and this leads to a dynamic stress spike of 5600 N.

The time taken for the curtain to fail into place may be estimated at under one second because its deployment corresponds approximately to a freefall from a height of 4 m.

This is a freefall and no guide is produced on the sides of the opening, as such guides will do nothing but slow the fall of the curtain or even block it in the event of deformation following the explosion.

The curtain comprises a ballast bar inserted into a fold of the curtain 5 that forms a coating as depicted in FIG. 1.

Figure 2:
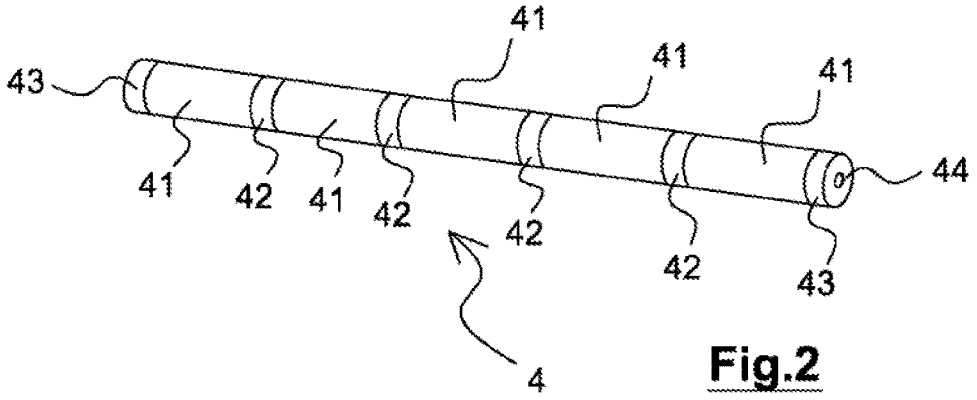
FIG. 2 is a perspective view of one aspect of a ballast bar of the device of FIG. 1.

The ballast bar 4 according to FIG. 2 is designed to provide sufficient mass for the curtain to deploy correctly and to encourage sealing at the interface.

For a curtain weighing 25 kg, with the dimensions given above, a ballast bar weighing, for example, of the order of 5 kg will help the curtain to fall.

The bar in the area of contact between curtain and ground, be deformable in order to minimize the leakage area in the event of debris generated by the explosion being trapped in the plane of closure of the curtain.

The ballast consists of a cord 44 made of polypropylene or some other strong material, for example with a diameter of 30 mm, onto which an alternation of medium or high density foam cylinders 41, for example 200 mm in length, and compressible and for example open-cell low-density foam cylinders 42, for example 40 mm in length are threaded. The low density foam is, for example, a polyether. It advantageously has a density of 17 to 20 kg/m$^3$.

The high density foam is, for example, a polyurethane foam. Its density is advantageously from 25 to 30 kg/m$^3$.

Each foam cylinder is bonded to a section of steel tube which provides the ballast and which allows easier use of the cord. Now the overall mass of the ballast in the example considered is around 8 to 12 kg.

Figure 3:
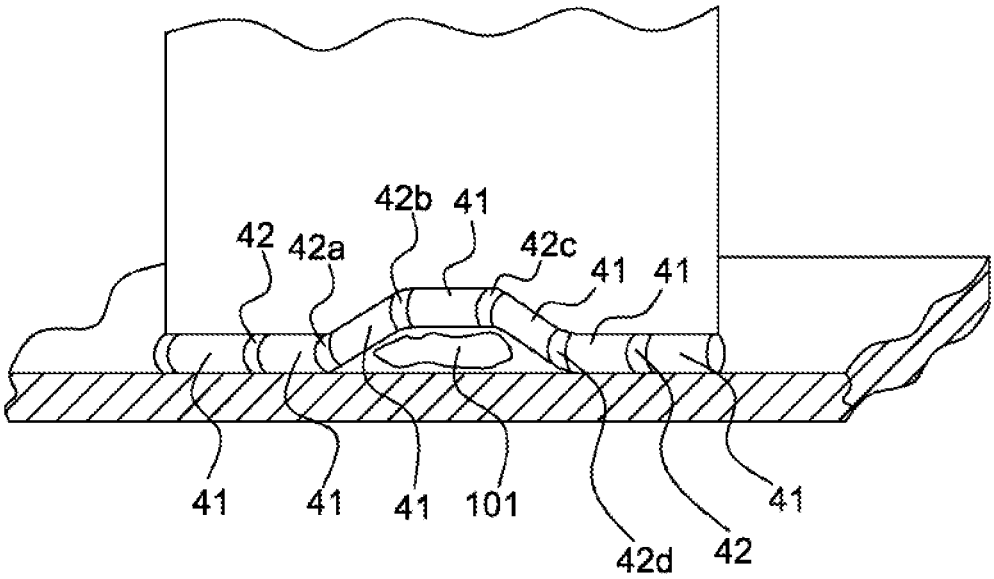
FIG. 3 is a perspective view of the ballast bar of FIG. 2 during operation.

As depicted in FIG. 3, if an obstacle 101, for example debris caused by the explosion, lies in the closure plane, the low-density cylinders 42*a*, 42*b*, 42*c*, 42*d* preferably deform to allow the weighted casing to conform to the shape of the obstacle, the cylinders 41 then hugging the obstacle.

The diameter of the ballast inserted into the casing is, for example, 80 mm and the low density and high density cylinders are sized to be able to hug an obstacle with a characteristic size of 100 mm.

Figure 4:
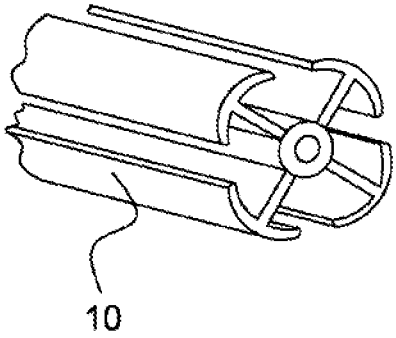
FIG. 4 is a perspective detail of one example of a stiffener according to one aspect of the disclosed embodiment.

Stiffeners 10 are uniformly distributed in the curtain 1 and the stiffeners are, for example, such as the extruded aluminum profile section of FIG. 4 which offers good stiffness for a low mass.

These stiffeners are needed because the containment zone is at a depression of 50 to 100 Pa under normal operation of the building in the case of a building in which chemical or pollutant products are handled. The stiffeners allow the curtain to be pressed firmly against the surround of the opening when the building returns to a state of depression after the explosion.

It is this depression which presses the curtain firmly against the door and which requires the curtain to be rigid.

Figure 5:
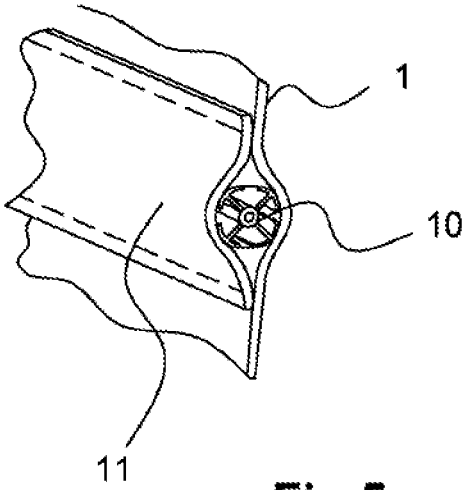
FIG. 5 is a perspective detail of the insertion of the stiffener of FIG. 4.

According to FIG. 5, in order to position this profile section, a strip of fabric 11 is stitched and/or bonded locally to the fabric of the curtain 1, for example leaving an opening at the ends of the strip, and the profile section is slipped in through the opening between the two fabrics.

Figure 6A:
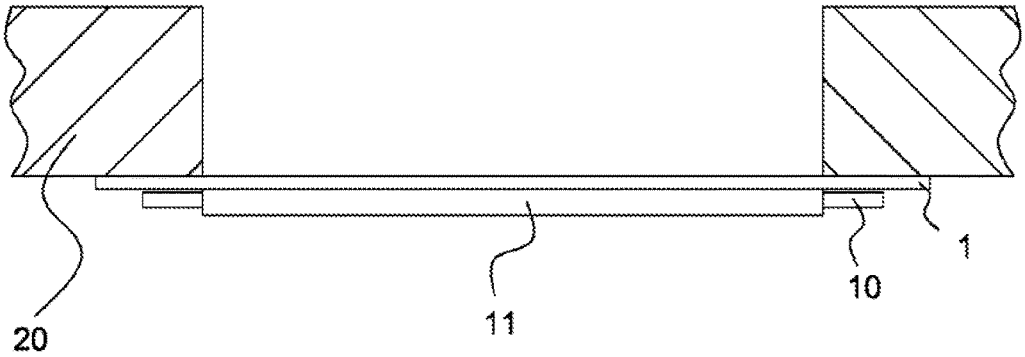
FIGS. 6A and 6B are views from above of a curtain of the device respectively at ambient pressure and in a state of depression.

As depicted in FIG. 6A, the length of the profile sections 10 is such that they press the curtain 1 against the lintels 20 of the door.

These profile sections are, however, shorter than the width of the curtain so that strips of curtain beyond the profile sections maintain their flexibility and can act as a seal against the wall under the effect of the depression. Thus, the curtain free on the lateral sides protrudes beyond the edges of the surround and with no lateral guidance provided the curtain simply hangs along the opening.

Figure 6B:
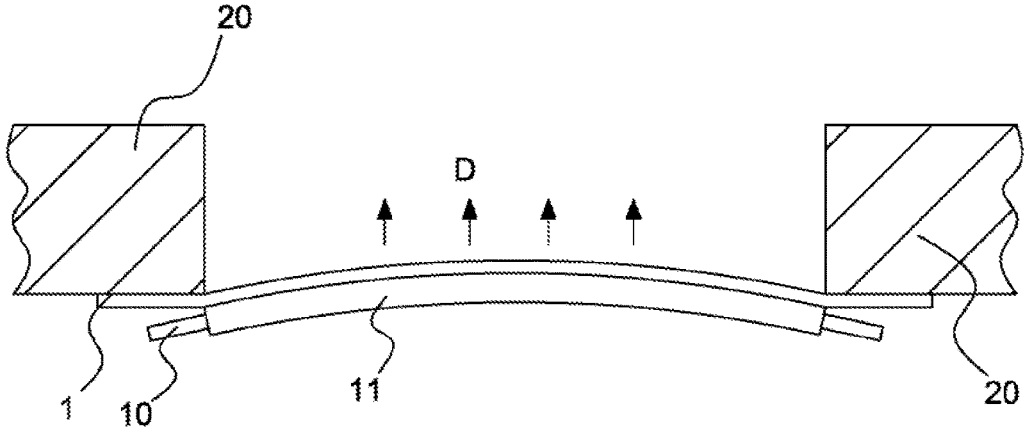

According to FIG. 6B, under the effect of the creation of a depression D in the room that is to be recontained, the suction of the curtain causes the stiffeners 10 to deform. In order for the ends of the stiffeners not to detach the curtain from the fixed frame, the casings 11 supporting the stiffeners stop in line with the fixed frame, leaving the stiffeners free beyond that.

Thus, as the stiffeners flex, their ends move away from the curtain which remains pressed firmly against the fixed frame.

By way of example, provision is made in the case of the door described hereinabove for the stiffeners to press against the fixed frame over 100 mm and for the curtain to press against the fixed frame over 200 mm.

Depending on the depression that is to be withstood, the aluminum profile section curtain stiffeners are, for example, stitched and/or bonded every 500 mm over the height of the curtain.

The curtain material is chosen according to the chemical resistance performance required but typically consists of a woven fabric coated on both sides with one or more layers of one or more sealing materials, the weave also being provided with the horizontal stiffeners distributed over the entire height of the curtain.

The material with which the curtain is coated needs to be a material that is chemically compatible with the gases, aerosols and dust given off in the explosion, namely a material that does not degrade in contact with these elements.

The material is, for example, a material containing glass fiber and PTFE or even an NBC (nuclear, bacteriological, chemical) or even NRBC (nuclear, radiological, biological, chemical) qualified material.

One example may be the material supplied by the Saint-Gobain company under the trade name Coretech Shelterguard 1450.

The weave of the curtain may notably be created using aramid or glass fiber.

The disclosed embodiment defined by the claims is not restricted to the examples given and notably applies to other openings and not just doors.

What is claimed is:

1. A containment device comprising a dry explosive gas containment curtain designed so as to deploy from a folded position to an extended position in response to a blast in a room or building so as to contain or recontain at least explosive gaseous discharge from a discharge zone made of an opening of said room or building, the containment device further comprising a ballast bar in a lower part of the curtain, wherein said ballast bar, providing a mass at a bottom of the curtain, includes an alternation of first cylinders, said first cylinders being made of a high density foam and of second cylinders, said second cylinders being made of compressible low density foam, and wherein said first and second cylinders effect conforming of the dry curtain to a ground surface and impede gases of the blast from escaping under the dry curtain.

2. The containment device as claimed in claim 1, wherein the first cylinders have a length of 100 mm to 300 mm.

3. The containment device as claimed in claim 1, wherein the second cylinders have a length of 20 mm to 60 mm.

4. The containment device as claimed in claim 1, wherein said first and second cylinders are threaded onto a cord.

5. The containment device as claimed in claim 1, wherein the second cylinders are designed to deform so that the ballast bar conforms to a shape of an obstacle on the ground, the first cylinders therefore resting against the shape of the obstacle.

6. The containment device as claimed in claim 1, wherein a diameter of the ballast is 60 mm to 100 mm, the first and second cylinders being sized so as to conform to an obstacle 50 mm to 150 mm thick.

7. The containment device as claimed in claim 1, comprising horizontal stiffeners evenly distributed in the curtain.

8. The containment device as claimed in claim 7, wherein the horizontal stiffeners are aluminum profile sections.

9. The containment device as claimed in claim 7, wherein strips of fabric for retaining the horizontal stiffeners are one or more of stitched and bonded locally to a fabric of the curtain, the horizontal stiffeners being at least partially disposed between the strips and the curtain.

10. The containment device as claimed in claim 9, wherein the strips of fabric supporting the horizontal stiffeners stop in line with a fixed frame of the opening that is to be recontained, leaving the horizontal stiffeners free beyond that.

11. The containment device as claimed in claim 10, wherein the horizontal stiffeners rest against the fixed frame over 50 mm to 100 mm, and the curtain rests against the fixed frame over 150 mm to 200 mm.

12. The containment device as claimed in claim 7, wherein a length of the horizontal stiffeners is such that said horizontal stiffeners press the curtain against lintels of the opening that is to be recontained when a room that is to be contained returns to a state of depression after the blast.

13. The containment device as claimed in claim 12, wherein the horizontal stiffeners are shorter than a width of the curtain such that flexibility of strips of curtain beyond the horizontal stiffeners is maintained, said strips of curtain beyond the horizontal stiffeners acting as a seal against the lintels or surround of the opening when the room that is to be contained returns to a state of depression after the blast.

14. The containment device as claimed in claim 7, wherein the horizontal stiffeners are stitched every 400 mm to 600 mm over a height of the curtain.

15. The containment device as claimed in claim 1, wherein the curtain comprises a glass weave and a PTFE coating.

16. The containment device as claimed in claim 1, wherein the low density foam has a density of 17 to 20 kg/m3.

17. The containment device as claimed in claim 1, for which the high density foam has a density of 25 to 30 kg/m3.

* * * * *